US010524594B2

(12) United States Patent
Yang

(10) Patent No.: US 10,524,594 B2
(45) Date of Patent: Jan. 7, 2020

(54) PORTABLE BABY SLEEPING BAG

(71) Applicant: Xiamen baby pretty products Co., Ltd., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 285 days.

(21) Appl. No.: 15/721,742

(22) Filed: Sep. 30, 2017

(65) Prior Publication Data

US 2018/0192797 A1 Jul. 12, 2018

(30) Foreign Application Priority Data

Jan. 10, 2017 (CN) ..... 2017 2 0024296 U

(51) Int. Cl.

*A47G 9/08* (2006.01)
*A47D 9/00* (2006.01)
*A47D 15/00* (2006.01)

(52) U.S. Cl.

CPC ..... *A47G 9/083* (2013.01); *A47D 9/00* (2013.01); *A47D 15/008* (2013.01)

(58) Field of Classification Search

CPC ..... A47G 9/083; A47D 9/00; A47D 15/008; A47D 9/005

USPC ..... 5/47, 59.1, 634

See application file for complete search history.

(56) References Cited

U.S. PATENT DOCUMENTS 945,449 A * 1/1910 Edgcombe ..... A61G 7/015 5/617
1,336,294 A * 4/1920 Hackman ..... A47C 20/027 5/634
3,492,680 A * 2/1970 Coolidge ..... A47D 9/005 5/99.1
3,931,653 A * 1/1976 Bien ..... A47C 20/027 5/634
4,185,342 A * 1/1980 Young ..... A47C 20/027 297/377
6,568,008 B2 * 5/2003 Siepmann ..... A61G 13/0018 5/617
7,146,662 B1 * 12/2006 Pollard ..... A47B 91/16 5/617

(Continued)

FOREIGN PATENT DOCUMENTS

CN 201550980 U 8/2010
CN 103549901 A 2/2014

*Primary Examiner* — Robert G Santos
*Assistant Examiner* — Myles A Throop
(74) *Attorney, Agent, or Firm* — Gokalp Bayramoglu

(57) ABSTRACT

The invention discloses a new portable baby sleeping bag, including a sleeping cradle. The front part of the sleeping cradle is provided with a first accommodation cavity. The rear part of the sleeping bag is provided with a second accommodation cavity. The first accommodation cavity is provided with a first frame. The second accommodation cavity is provided with a second frame. The inner bottom surface of the second frame is provided with a receiving groove. An adjustment mechanism for adjusting the height of the backrest is provided between the bottom surface of the backrest and the bottom surface of the receiving groove. The width and the height of the first frame are respectively smaller than the width and height of the second frame. The bottom of the middle front part of the sleeping cradle is provided with a sealing edge.

7 Claims, 6 Drawing Sheets

(56) References Cited

U.S. PATENT DOCUMENTS

| | | | | | |
|---|---|---|---|---|---|
| D640,483 | S * | 6/2011 | Daley | ..... | A47D 9/005<br>D6/333 |
| 2002/0002741 | A1 * | 1/2002 | Tomas | ..... | A47D 9/00<br>5/101 |
| 2017/0295943 | A1 * | 10/2017 | Barr | ..... | A47C 19/025 |

* cited by examiner

PORTABLE BABY SLEEPING BAG

CROSS REFERENCE TO RELATED APPLICATION

This application is based upon and claims priority to Chinese Patent Application No. 201720024296.X, filed on Jan. 10, 2017, the entire contents of which are incorporated herein by reference.

TECHNICAL FIELD

The present invention relates to the field of children product, particularly to a new portable baby sleeping bag.

BACKGROUND

When the adult is taking a rest, it is necessary to avoid mistakenly pressing or muffling the baby by the adult. Meanwhile, there is a need to alleviate the burden of an adult while holding a baby for a long time in his/her arms while baby is sleeping. Thus, more and more parents put their baby in a sleeping cradle to let the baby sleep alone. The existing sleeping cradle mainly includes a sleeping cradle body, a cover wrapping the sleeping cradle body, and a sleeping mat positioned inside the sleeping cradle body. The structure of the above sleeping cradle is mainly suitable for home use. Since the sleeping cradle body cannot be folded and has a large size, it would be inconvenient to carry the sleeping cradle taking a long journey. Thus, it is challenging for parents to provide a good environment for their baby to rest when parents and their baby are away from parents home.

SUMMARY OF THE INVENTION

The present invention provides a new portable baby sleeping bag. The purpose of the present invention is to overcome the problem of difficulty of carrying existing baby sleeping cradle.

In order to solve the above technical problem, the present invention uses the technical solutions as below:

Anew portable baby sleeping bag includes a sleeping cradle cover. The front part of the sleeping cradle cover is provided with a first accommodation cavity, and the rear part of the sleeping hag is provided with a second accommodation cavity. The first accommodation cavity is provided with a first frame, and the second accommodation cavity is provided with a second frame. The inner bottom surface of the second frame is provided with a receiving groove, in which a backrest is provided. The front part of the backrest is hinged to the front part of the receiving groove. The adjustment mechanism for adjusting the height of the backrest is provided between the bottom surface of the backrest and the bottom surface of the receiving groove. The width and the height of the first frame are respectively smaller than the width and height of the second frame. The sleeping cradle cover is provided with a sleeping mat which fits the size of the sleeping cradle cover. The sleeping mat is provided with a baby pillow which is arranged correspondingly to the backrest. The bottom of the middle front part of the sleeping cradle cover is provided with a sealing edge. The edge of the sealing edge is provided with a first zipper strip, and the edge of the top surface of the rear part of the sleeping cradle cover is provided with a second zipper strip which engages with the first zipper strip.

The adjusting mechanism includes a lifting plate and a threaded rod. The front end of the lifting plate is hinged to the middle of the bottom surface of the backrest. The rear end of the lifting plate is provided with a cross bar. The middle part of the cross bar is fixedly connected to the front end of a connecting block. The rear end of the connecting block is detachably connected to the front end of the threaded rod. The rear end of the threaded rod extends beyond the rear end surface of the sleeping cradle cover. The rear part of the bottom surface of the second frame is provided with a threaded block which fits the threaded rod. Each of the left and the right side surfaces of the receiving groove is provided with a movable groove. Each of the two ends of the cross bar are located in the corresponding movable groove respectively.

Further, the rear end of the connecting block is provided with a through groove. The front end of the threaded, rod is provided with a round wheel which fits the through groove.

Further, a limiting plate is provided on one side of the movable groove.

Further, the first accommodation cavity and second accommodation cavity are sealed by a zipper.

Further, the sleeping mat includes a mat cover and a 3D mesh layer positioned inside the mat cover.

Further, the baby pillow is a baby latex pillow.

Further, the rear end surface of the sleeping cradle cover is provided with a handle.

According to the above description of the present invention, compared with the prior art, the present invention has the following advantages. The present invention has a novel structure and smart design. When the present invention is used properly, the sleeping cradle cover is in an unfolded state. The baby can be placed in the sleeping cradle cover to sleep. At the same time, the inclined height of the backrest can be changed by adjusting the adjustment mechanism based on the need. Especially during the feeding, the backrest can be adjusted to a reasonable position to prevent the baby from spitting the milk. When the parents need to travel with the baby, since the width and the height of the first frame are respectively smaller than the width and the height of the second frame, the front portion of the sleeping cradle cover can be folded into the rear portion of the sleeping cradle cover. Next, the first zipper strip and the second zipper strip engage with each other, so that the sleeping cradle cover can be folded into a bag, greatly reducing the space occupied by the sleeping cradle cover. Also, when the parents are going outside, the folded bag is easy to carry.

DETAILED DESCRIPTION OF THE INVENTION

Figure 1:
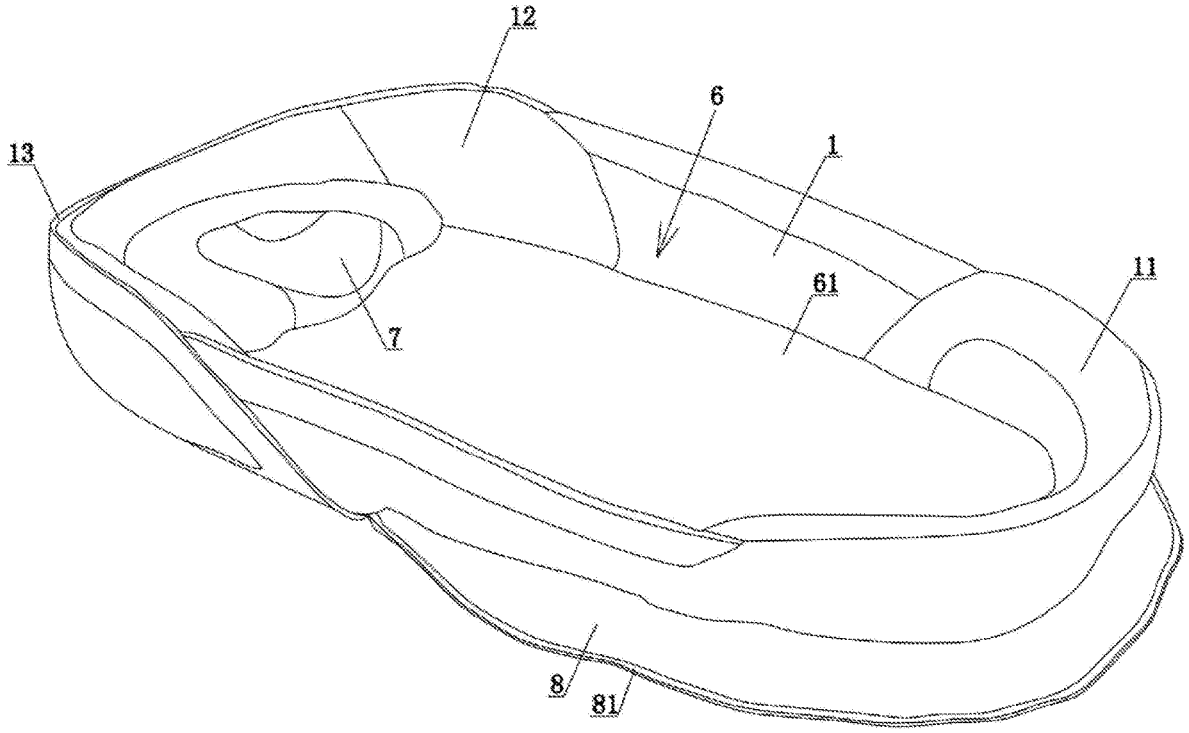
FIG. 1 is a state diagram when the present invention is used.
Figure 2:
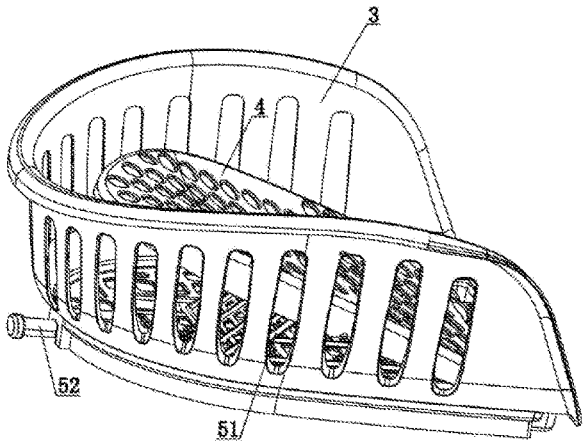
FIG. 2 is a structural diagram of the first frame and the second frame of the present invention.
Figure 2:
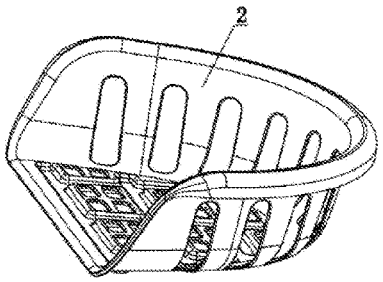

Referring to FIGS. 1 to 5, a new portable baby sleeping bag includes sleeping cradle cover 1. The front part of sleeping cradle cover 1 is provided with first accommodation cavity 11. The rear part of sleeping cradle cover 1 is provided with second accommodation cavity 12. First accommodation cavity 11 is provided with first frame 2. Second accommodation cavity 12 is provided with second frame 3. The inner bottom surface of second frame 3 is provided with receiving groove 31. Receiving groove 31 is provided with backrest 4. The front end of backrest 4 is hinged to the front end of receiving groove 31. Adjustment mechanism 5 is provided between the bottom surface of backrest 4 and the bottom surface of receiving groove 31. Adjustment mechanism 5 is configured to adjust the height of backrest 4. First accommodation cavity 11 and second accommodation cavity 12 are sealed by a zipper. The width and the height of first frame 2 are respectively smaller than the width and height, of second frame 3. Sleeping cradle cover 1 is provided with sleeping mat 6 which fit the size of the sleeping cradle. Sleeping mat 6 is provided with baby pillow 7. Baby pillow 7 is provided correspondingly to backrest 4. The bottom surface of the middle-front part of sleeping cradle cover 1 is provided with sealing edge 8. The edge of sealing edge 8 is provided with first zipper strip 81. The edge of the top surface of the rear part of sleeping cradle cover 1 is provided with second zipper strip 13 which engages with first zipper strip 81.

Referring to FIGS. 1 to 6, adjusting mechanism 5 includes lifting plate 51 and threaded rod 52. The front end of lifting plate 51 is hinged to the middle part of the bottom surface of backrest 4. The rear end of lifting plate 51 is provided with cross bar 511. The middle part of cross bar 511 is fixedly connected to the front end of connecting block 53. The rear end of connecting block 53 is detachably connected to the front end of threaded rod 52. The rear end of threaded rod 52 extends beyond the rear end surface of sleeping cradle cover 1. The rear part of the bottom surface of second frame 3 is provided with threaded block 54 which fits threaded rod 52. Each of the left and the right side surfaces of receiving groove 31 is provided with movable groove 311. Each of the two ends of cross bar 511 is located inside corresponding movable groove 311 respectively. The rear end of connecting block 53 is provided with through groove 531. The front end of threaded rod 52 is provided with round wheel 521 which fits through groove 531. When threaded rod 52 is connected to connecting block 53, round wheel 521 is directly installed from the side surface of through groove 531. One side of movable groove 311 is provided with limiting plate 312. Limiting plate 312 is configured to ensure that cross bar 511 does not generate a large displacement in the left and right directions when the cross bar moves forward and backward. Movable groove 311 provides a movable space for cross bar 511. Also, movable groove 311 is configured to restrict the rising height of lifting plate 51.

Figure 3:
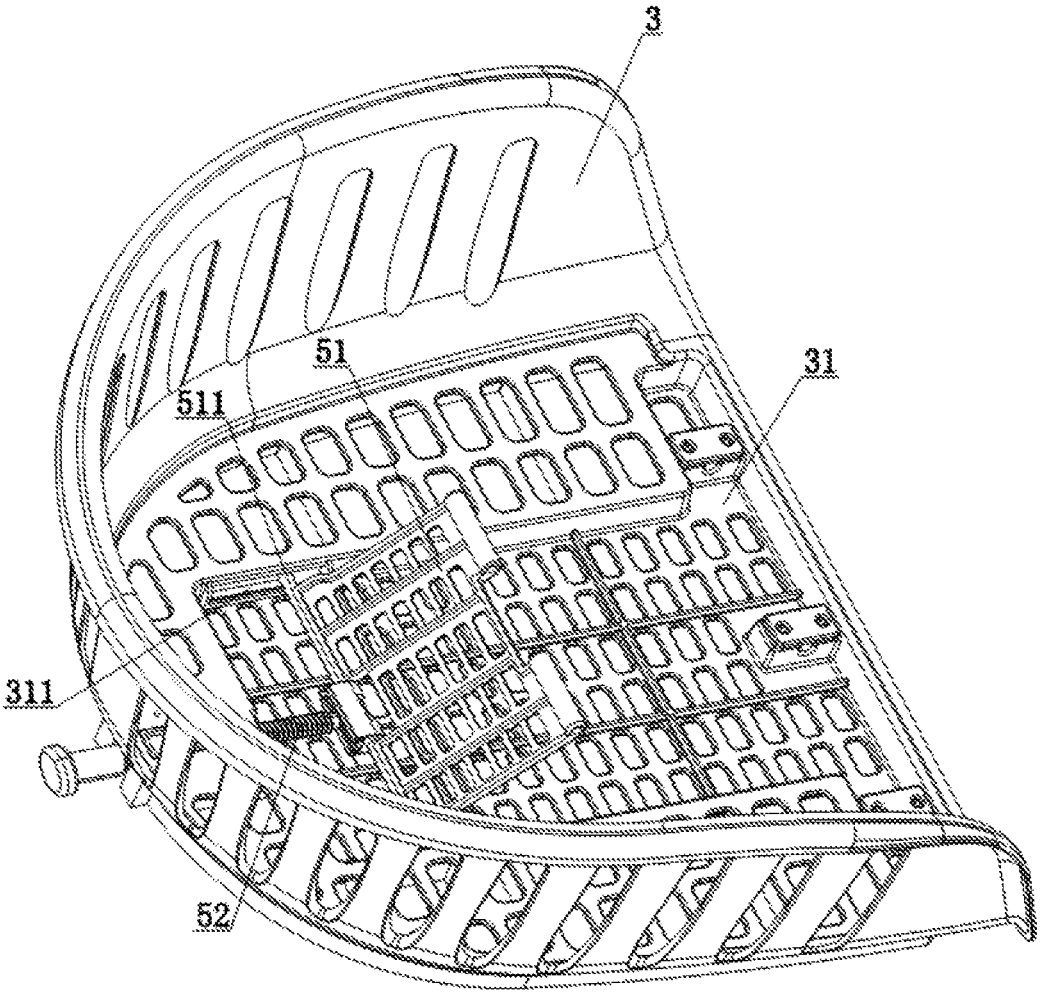
FIG. 3 is a structural diagram of a connection between the second frame and an adjustment mechanism of the present invention.
Figure 4:
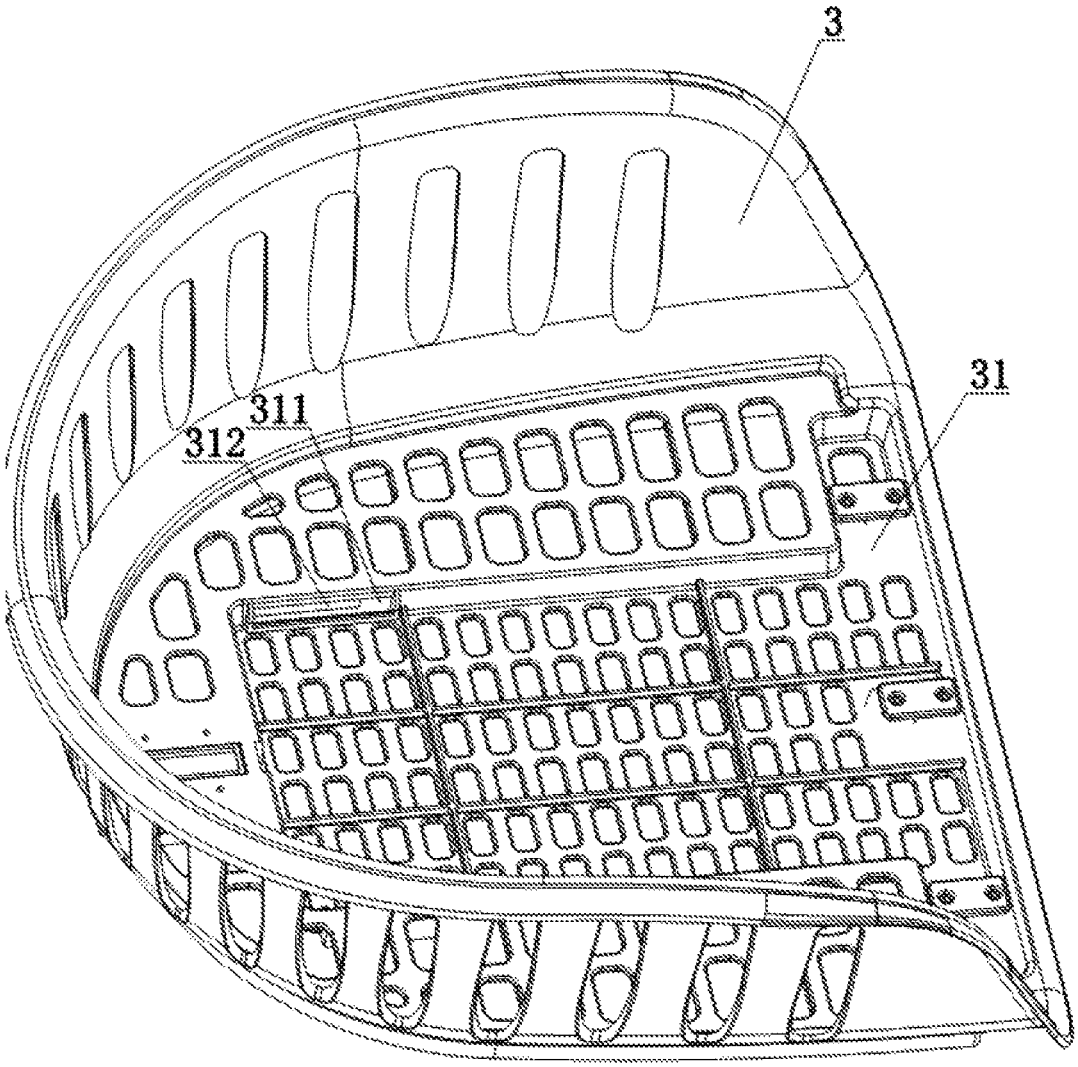
FIG. 4 is a structural diagram of the second frame of the present invention.
Figure 5:
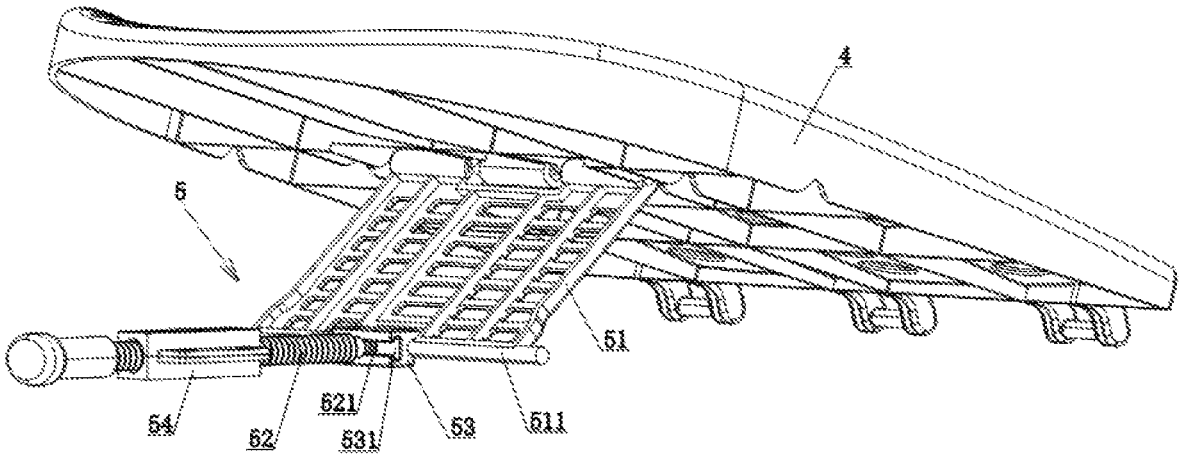
FIG. 5 is a structural diagram of a connection between the backrest and the adjustment mechanism of the present invention.

Referring to FIGS. 3 to 5, when threaded rod 52 is driven to rotate forward, the height of lifting plate 51 gradually increases due to the pushing of threaded rod 52. Accordingly, backrest 4 is driven to rise gradually. When backrest 4 reaches an appropriate angle, the rotation of threaded rod 52 is stopped. At this point, the backrest can be fixed at a certain height. On the contrary, when threaded rod 52 is driven to rotate backward, lifting plate 51 and backrest 4 descend. The rotation of threaded rod 52 is stopped when lifting plate 51 and backrest 4 descend to a desired position.

Figure 6:
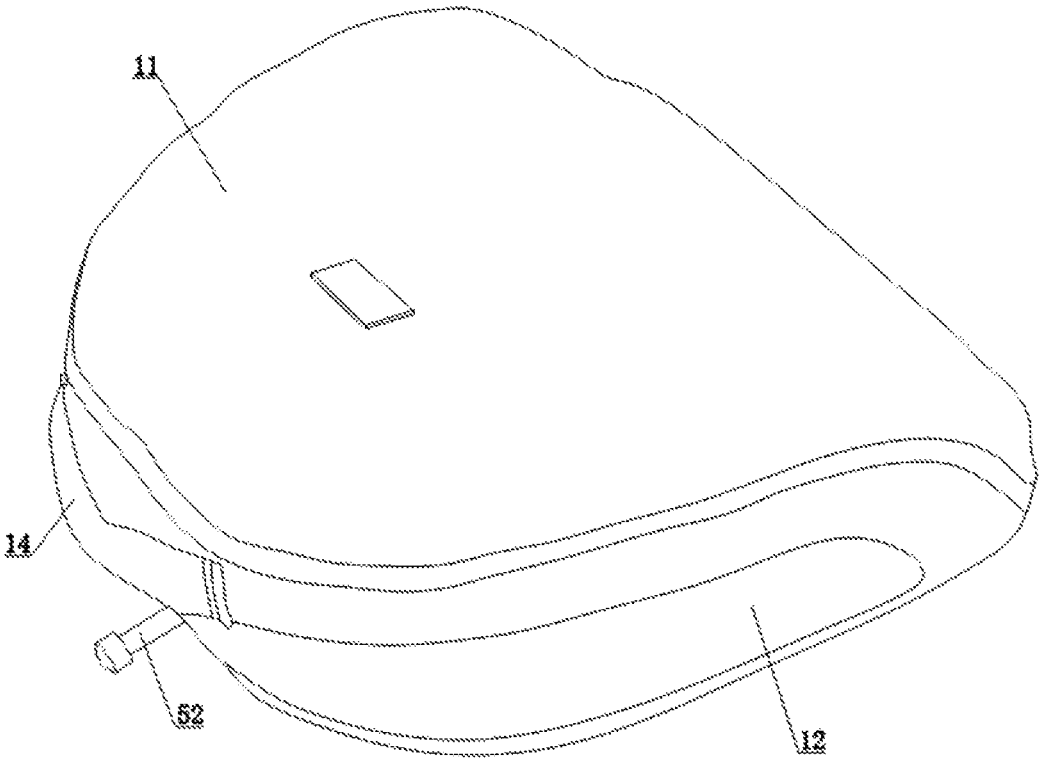
FIG. 6 is a state diagram of the present invention after being folded.

Referring to FIGS. 1 and 6, sleeping mat 6 includes a mat cover 61 and a 3D mesh layer (not shown in the figures) provided in mat cover 61. Baby pillow 7 is a baby latex pillow. 3D mesh layer (not shown in figures) is soft and comfortable, and has good ventilation property. The baby latex pillow has good hygroscopicity, air permeability, and resilience, so as to provide a comfortable environment for the baby's sleep. The rear end surface of sleeping cradle cover 1 is provided with handle 14. Handle 14 facilitates the carrying of the bag into which the sleeping cradle can be folded.

The above are different embodiments of the present invention. However, the design concept of the present invention is not limited to these embodiments. Any non-substantive modification to the present invention using the design concept should be considered within the scope of the present invention.

What is claimed is:

1. A new portable baby sleeping bag, comprising a sleeping cradle cover, wherein a front part of the sleeping cradle cover is provided with a first accommodation cavity;

a rear part of the sleeping bag is provided with a second accommodation cavity;

the first accommodation cavity is provided with a first frame;

the second accommodation cavity is provided with a second frame;

an inner bottom surface of the second frame is provided with a receiving groove;

a backrest is provided inside the receiving groove;

a front end of the backrest is hinged to the front end of the receiving groove;

an adjustment mechanism is provided between a bottom surface of the backrest and a bottom surface of the receiving groove;

the adjustment mechanism is configured to adjust the height of the backrest;

a width and a height of the first frame are respectively smaller than a width and a height of the second frame;

the sleeping cradle cover is provided with a sleeping mat;

the sleeping mat fits a size of the sleeping cradle;

the sleeping mat is provided with a baby pillow;

the baby pillow is arranged correspondingly to the backrest;

the bottom surface of the middle-front part of the sleeping cradle is provided with a sealing edge;

an edge of the sealing edge is provided with a first zipper strip;

an edge of a top surface of a rear part of the sleeping cradle is provided with a second zipper strip;

the second zipper strip engages with the first zipper strip;

the adjusting mechanism includes a lifting plate and a threaded rod;

a front end of the lifting plate is hinged to a middle part of the bottom surface of the backrest;

a rear end of the lifting plate is provided with a cross bar;

a middle part of the cross bar is fixedly connected to a front end of a connecting block;

a rear end of the connecting block is detachably connected to a front end of the threaded rod;

a rear end of the threaded rod extends beyond a rear end surface of the sleeping cradle cover;

a rear part of a bottom surface of the second frame is provided with a threaded block;

the threaded block fits the threaded rod;

each of left and right side surfaces of the receiving groove is provided with a movable groove; and each of two ends of the cross bar is located inside a corresponding movable groove respectively.

2. The new portable baby sleeping bag according to claim 1, wherein a rear end of the connecting block is provided with a through groove;

the front end of the threaded rod is provided with a round wheel; and the round wheel fits the through groove.

3. The new portable baby sleeping bag according to claim 1, wherein a limiting plate is provided on one side of the movable groove.

4. The new portable baby sleeping hag according to claim 1, wherein the first accommodation cavity and the second accommodation cavity are sealed by a zipper.

5. The new portable baby sleeping bag according to claim 1, wherein the sleeping mat includes a mat cover and a 3D mesh layer positioned inside the mat cover.

6. The new portable baby sleeping bag according to claim 1, wherein the baby pillow is a baby latex pillow.

7. The new portable baby sleeping bag according to claim 1, wherein the rear end surface of the sleeping cradle cover is provided with a handle.

* * * * *